US006660128B1

(12) United States Patent
Bourbonnais et al.

(10) Patent No.: US 6,660,128 B1
(45) Date of Patent: Dec. 9, 2003

(54) OXIDASE PROCESS FOR PULP

(75) Inventors: Robert Bourbonnais, Ville St-Laurent (CA); Dominic Rochefort, Montréal (CA); Michael G. Paice, Pointe Claire (CA); Sylvie Renaud, Laval (CA); Dónal Leech, Bushypark (IE)

(73) Assignees: Pulp and Paper Research Institute of Canada, Pointe Claire (CA); Universié de Montréal, Montreal (CA)

( * ) Notice: Subject to any disclaimer, the term of this patent is extended or adjusted under 35 U.S.C. 154(b) by 81 days.

(21) Appl. No.: 09/685,066

(22) Filed: Oct. 10, 2000

Related U.S. Application Data

(63) Continuation of application No. PCT/CA99/00319, filed on Apr. 13, 1999.
(60) Provisional application No. 60/081,910, filed on Apr. 16, 1998.

(51) Int. Cl.[7] ..... D21C 9/10; D21C 9/14; D21C 9/147

(52) U.S. Cl. ..... 162/65; 162/72; 162/78; 162/79; 162/87; 162/88

(58) Field of Search ..... 162/72, 65, 67, 162/78, 90, 79, 87, 88; 435/277, 278

(56) References Cited

U.S. PATENT DOCUMENTS

| | | | | | |
|---|---|---|---|---|---|
| 5,203,964 | A | * | 4/1993 | Call | 162/72 |
| 5,691,193 | A | | 11/1997 | Paice et al. | |
| 6,103,059 | A | * | 8/2000 | Call | 162/72 |

FOREIGN PATENT DOCUMENTS

| | | |
|---|---|---|
| CA | 1129161 | 8/1982 |
| CA | 2 078 345 | 9/1991 |
| DD | 280 790 | 7/1990 |
| EP | 0 252 747 | 1/1988 |
| EP | 0 447 673 | 9/1991 |
| WO | WO 92/09741 | 6/1992 |
| WO | WO 94/12621 | 6/1994 |
| WO | WO 94 16056 | 7/1994 |
| WO | WO 95/01426 | 1/1995 |
| WO | WO 97/06244 | 2/1997 |
| WO | WO 97/36039 | 10/1997 |
| WO | WO 97/36041 | 10/1997 |

OTHER PUBLICATIONS

Demethylation and Delignification of kraft pulp by Trametes versicolor laccase in the presence of 2,2'–azinobis–(3–ethylbenzthiazoline–6–sulphonate) Bourbonnais et al, Applied Microbiology and Biotechnology, Springer–Verlag 1992, 36:823–827.

Process for Modifying, Breaking Down or Bleaching Lignin, Materials containing Lignin or Like Substances Call et al.

The effect of metal complexes in the electrochemically mediated oxygen bleaching of wood pulp, Perng et al, Bleaching, vol. 76, No. 10 Tappi Journal, pp. 139 to 147.

Catalytic oxygen bleaching of wood pulp with metal porphyrin and phthalocyanine complexes, Perng et al, Pulp Bleaching, vol. 77, No. 11 Tappi Journal, pp. 119 to 125.

Delignification with Acidic Hydrogen Peroxide Activated by Molybdate, Kubelka et al, Journal of Pulp and Paper Science, vol. 18, No. 3, May 1992, pp. J108 to 114.

Reinforcement of oxygen–based bleaching chemicals with molybdates, Agnemo, 9th ISWPC Proceedings 1997, D2–1–4.

* cited by examiner

*Primary Examiner*—Steve Alvo
(74) *Attorney, Agent, or Firm*—Ogilvy Renault

(57) ABSTRACT

A method for selectively delignifying lignocellulosic materials and bleaching of pulp and dyes using a combination of an oxidative enzyme and a metal complex. More specifically, the process involves the oxidation of a transition metal redox complex by a phenol oxidizing enzyme such as laccase or peroxidase to mediate the catalytic delignification of chemical pulp and bleaching of textile dye. This process is unique in that only a catalytic amount of metal complex mediator is required on softwood or hardwood kraft pulp, and that recycling or regeneration of the mediator for further pulp delignification is possible. The redox mediator is characterized in that it contains a transition metal ion coordinated with molecules or ions in such a way that the complexes have a formal redox potential between 0.5 and 1.2 volt measured against a normal hydrogen electrode.

19 Claims, No Drawings

OXIDASE PROCESS FOR PULP

CROSS REFERENCE TO RELATED APPLICATION

This Application-is a Continuation of PCT/CA 99/00319, filed Apr. 13, 1999, in which the United States of America was designated and elected, and which remains pending in the International Phase until Oct. 16, 2000, which Application in turn claims priority from U.S. Provisional Application Ser. No. 60/081,910, filed Apr. 16, 1998.

This Application claims priority under 35 U.S.C. 119(e) from U.S. Provisional Application Ser. No. 60/081,910, filed Apr. 16, 1998.

FIELD OF THE INVENTION

The invention relates to an enzymatic redox catalytic process to delignify and bleach lignocellulosic materials, and oxidise dyes to remove colour, and more specifically a process involving phenol oxidases and a transition metal complex.

BACKGROUND ART

Bleaching of kraft pulp is traditionally performed by sequential reaction with chlorine or chlorine dioxide and sodium hydroxide. Environmental concerns and system closure requirements have opened up new opportunities for biotechnology to replace the use of chlorine or chlorine dioxide in pulp bleaching operations.

Enzyme application for pulp bleaching was first reported by Viikari et al., Proc. Third Intl. Conf. Biotechnol. Pulp Paper Industry, Stockholm, 67–69, 1986. The enzyme xylanase was found to enhance the effect of bleaching chemicals by hydrolyzing the xylan network surrounding lignin. The enzymatic treatment usually results in a 10 to 20% saving of bleaching chemicals. Larger chemical savings can be obtained by using a fungal culture of *Trametes* (*Coriolus*) *versicolor*, but the rate of biodelignification is too slow for commercial application (Paice et al., Tappi J. 72(5): 217–221, 1989, Reid et al., Tappi J. 73 (8): 149–15, 1990). The fungal bleaching effect is accompanied by the secretion of at least two lignin-oxidizing enzymes, laccase and manganese peroxidase (Bourbonnais and Paice, Appl Microbiol Biotechnol 36: 823–827, 1992; Paice et al., Appl. Environ. Microbiol. 59: 260–265, 1993).

Laccase is a multicopper oxidase which reduces oxygen to water and simultaneously performs one-electron oxidation of many aromatic substrates (Reinhammar et al, Boca Raton, Florida: CRC Press, Vol. 3, pp. 1–35, 1984). Laccase alone has a limited effect on pulp bleaching due to its specificity for phenolic subunits in lignin (Higuchi, NG Lewis, MG Paice, eds. Plant cell wall polymers: biogenesis and biodegradation. ACS Symposium Series, 399: 482–502, 1989). It has been reported that the substrate range of laccase can be extended to non-phenolic subunits of lignin by inclusion of a mediator such as 2,2'-azinobis-(3-ethylbenzthiazoline-6-sulfonate) (ABTS) (Bourbonnais and Paice, FEBS Lett 267: 99–102, 1990). Furthermore, the laccase and ABTS couple was also shown to effectively demethylate and delignify kraft pulp (Bourbonnais and Paice, Appl Microbiol Biotechnol 36: 823–827, 1992);

Over 50% delignification was reported with laccase/ABTS followed by alkaline extraction under conditions of time, temperature and consistency compatible with current bleaching technology (Bourbonnais and Paice, Tappi J 79(6): 199–204, 1996).

Since the initial report with the mediator ABTS, there has been intense research activity to discover a cost-effective laccase/mediator combination, and several nitrogen-containing aromatic compounds are now known to be at least as effective as ABTS. In a series of patent applications, Call describes a process for modifying, breaking down or bleaching lignin, where mediators of the family of N-hydroxy aromatic compounds such as 1-hydroxybenzotriazole (HBT) (WO94/29510), violuric acid (WO 97/36039) and N-hydroxyacetanilide (NHAA) (WO 97/36041) were used. Furthermore, Zing et al. (WO 97/06244) describe the use of nitroso-hydroxy aromatic compounds for enhancing the bleaching activity of laccase for pulp and textile applications. In WO 94/12619, WO 94/12620 and WO 94/12621 Schneider et al. proposed the application of peroxidase enzyme in the presence of hydrogen peroxide and several aromatic compounds to bleach lignin-containing material and textile dye. More recently, Schneider and Pedersen (WO 95/01426) proposed the application of several aromatic compounds to mediate laccase-catalyzed bleaching of textile dyes. Vaheri and Piirainen (International Application WO 92/09741) claim that the oxidizing enzyme laccase can be used in conjunction with manganese ions to reduce consumption of chlorine chemicals when applied in the later stages of bleaching. In their process manganese ions were used to control the redox potential of the pulp within a range between 0.05 to 0.3 V. However, delignification of pulp was not shown under these conditions. In U.S. Pat. No. 5,691,193 (1997) we have described a process for the bleaching of kraft pulp with non-chlorine chemicals where, in a first step, pulp is oxidized either with manganese peroxidase enzyme in the presence of Mn(II) ions and hydrogen peroxide or with laccase enzyme in the presence of 2,2'-azinobis-(3-ethylbenzthiazoline-6-sulfonate) (ABTS) and is followed by an alkaline peroxide bleaching step. Combinations of laccase and aromatic mediators have also been described for other applications such as degradation of polycyclic aromatic hydrocarbons (Johannes et al., Appl. Microbol. Biotechnol 46: 313–317, 1996) and chemical synthesis (Potthast et al., J. Mol. Catal. A: Chem 108: 5–9, 1996).

The. use of transition metal complexes as oxygen or peroxide catalysts has been reported for several applications. In the field of pulping and bleaching, ions of Fe, Mn, Co, Cr, Cu and V with various ligands were studied in oxygen bleaching experiments (Perng et al., Tappi J., 76(10), 139–147 (1993) and Tappi J., 77(11), 119–125 (1994)). From these, only iron complexes (ferricyanide, Fe/2,2'-dipyridyl and ferrate) were found to increase oxygen delignification of pulp. However the oxygen catalyzed reactions were not specific to lignin under the conditions claimed, and significant loss of pulp viscosity occurred. Sodium molybdate and sodium tungstate were proposed by Eckert (Canadian Patent 1,129,161 (1982)) to catalyze acidic $H_2O_2$ delignification of krafi pulp. In a more recent study, Kubelka et al. (JPPS, 18(3), J108–114, i992) describe a process consisting of an acidic peroxide stage catalysed by sodium molybdate followed by an alkaline oxygen stage. This process was shown to increase pulp delignification by a factor of about 25% but with an equivalent loss in pulp viscosity. Furthermore, Agnemo ($9^{th}$ ISWPC Proceedings 1997, d2-1 –d2-4) proposed the addition of molybdates to reinforce oxygen and ozone delignification at pH 5.

None of the above described research reports or patent specifications mention the combined use of a transition metal complex with laccase to mediate the catalytic delignification of cellulosic materials and bleaching of pulp.

Furthermore, in all applications previously described, there was no mention of the recyclability of the redox mediator.

SUMMARY OF THE INVENTION

It is an object of this invention to provide a process for oxidizing a substrate.

It is a particular object of the invention to provide a selective and catalytic process for pulp delignification or bleaching, driven by the enzymatic oxidation of a transition metal complex which can be regenerated for further pulp delignification or bleaching.

In accordance with the invention, there is provided a process for oxidizing a substrate comprising:

a) reacting a substrate to be oxidized with:
   i) a phenol oxidase, and
   ii) a transition metal complex redox mediator, b) oxidizing said complex ii) with said oxidase i) from a reduced state to an oxidized state, and c) oxidizing said substrate with said complex ii) in said oxidized state, said substrate being selected from lignocellulosic pulp, cellulosic pulp, paper dye and textile dye, whereby a lignocellulosic pulp is delignified by said oxidizing, and a cellulosic pulp, paper dye or textile dye is bleached by said oxidizing.

DESCRIPTION OF THE PREFERRED EMBODIMENTS OF THE INVENTION

The process of the invention may be applied to the delignification and bleaching of kraft or sulphite pulps employing an oxidative enzyme and a transition metal complex which is a redox mediator and serves as a selective catalytic delignifying or bleaching agent. The principle of the invention is that a transition metal complex is oxidized by a phenol oxidase, for example, a laccase (E.C. 1.10.3.2) or a peroxidase (E.C. 1.11.1.7) and can then diffuse within the lignocellulosic fiber of the pulp to mediate selective catalytic lignin oxidation or bleaching. During this reversible redox process, the complex is continuously regenerated following its reaction with lignin and is made available for further reaction. The complex or mediator is characterized in that it contains a transition metal ion, preferably molybdenum, iron or tungsten, ligated in such a way, with molecules or ions, that the complex has a redox potential between 0.5 and 1.2 V (vs NHE (normal hydrogen electrode)).

Suitable complexes or mediators are those of the general formula 1:

$$M^{m+}(L)_n$$

in which:

M represents a transition metal cation, m+ represents the charge of the metal cation, L represents a ligand molecule forming a complex with the metal ion, and n represents the number of ligands L in the complex.

Suitably M is molybdenum, tungsten or iron; m is an integer of 1 to 6; L is selected from cyano (CN-), bipyridyl (bipy), 1,10-phenanthroline (o-phen), thiocyanato (SCN-), amine ($NH_3$) or carbonyl (CO), and n is an integer of 1 to 8.

This novel process allows the use of small amounts of the complex or mediator and a recycling of the regenerated complex or mediator for further pulp delignification.

The invention can also be applied to bleach dyes from paper or textiles so as to remove or strip colour from paper or textiles.

As employed herein a phenol oxidase refers to an oxidase enzyme having the characteristics or capability of oxidizing phenols, polyphenols, aromatic nitrogen compounds, or transition metal complexes.

The principle of this invention is based on a three step coupled reaction system shown in Equation 1 characterized by I) an oxidase enzyme for example of the family laccase using $O_2$ as electron acceptor or peroxidase with $H_2O_2$ where the role of the enzyme is to oxidize a mediator, II) a transition metal redox mediator cycling between its reduced state ($M^{m+}$) to its oxidized state ($M^{(m+1)+}$) and III) the lignin polymer in the pulp fibre or a dye which is oxidized and solubilized following its reaction with the mediator.

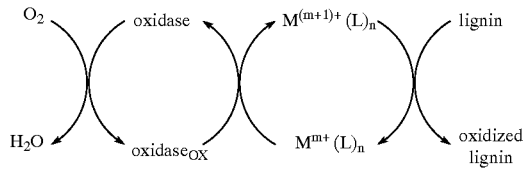

Oxidase = laccase or peroxidase $M^{m+}$ = Transition metal ions of Mo, Fe, W with n coordinates L = Ligands suh as CN, bipyridine, o-phenanthroline, CO, $NH_3$ $E_0(M^{m+}/M^{(m+1)+})$ = 0.5 to 1.2 V (vs NHE)

Equation 1: representation of the delignifying process

The present invention can be applied to delignify and bleach hardwood and softwood kraft or sulfite pulps produced by a batch or continuous process including lower-lignin content pulps such as those produced by modified continuous cooking or by oxygen delignification or by xylanase delignification.

The pulp is suitably washed with water and acidified for example by adding sulfuric acid or by adding gases such as carbon dioxide or sulfur dioxide to pH between 3 and 6. The acidified pulp at a consistency of between 2 and 20% is mixed with a solution of the mediator containing the phenol oxidase, for example, laccase with oxygen, or peroxidase with hydrogen peroxide. In a particular embodiment illustrating the invention, the pulp is placed in a vessel at a temperature of between 25° C. and 70° C. for a period of time between 30 minutes and 240 minutes. For laccase treatment, the reaction proceeds under oxygen atmosphere preferably with a pressure of between 100 kPa to 500 kPa.

The present invention can also be applied under essentially the same conditions to dye bleaching in order to modify or remove colour from paper and textiles.

At the end of the treatment, the pulp is pressed, and the extracted liquor may be kept for further batchs of pulp delignification. The recycled mediator can be used to delignify a new batch of pulp or used to delignify the same pulp in a second cycle following an alkaline extraction. With or without further washing, the pulp is then extracted, for example, with 2% sodium hydroxide at 70° C. for 90 minutes. The alkaline extraction (E) may be done under an atmosphere of oxygen (Eo) and may contain hydrogen peroxide (Ep). The resulting pulp can be bleached in accordance with any of the well-known conventional bleaching sequences such as ECF with chlorine dioxide steps or TCF with oxygen based chemicals (i.e. $O_3$ or $H_2O_2$).

The amount of mediator used is specified in % (g per 100 g of oven dried pulp). Suitable amounts of the mediator can be readily determined by experiment. In particular, trial amounts of mediator of 0.05% to 1% have provided good results. By way of example, suitable mediators or complexes include potassium octacyanomolybdate ($K_4Mo(CN)_8 \cdot 2H_2O$) which may be prepared according to Furman and Miller (Inorg. Synth. 3, 160–163, 1950); potassium octacyanotungstate ($K_4W(CN)_8$. $2H_2O$) which may be synthesized by the method described by Heintz (Inorg. Synth. 7, 142–146, 1963); iron tris-4,4'dimethyl-bipydine [FeII(4,4'dmbpyr)$_3$] which may be prepared by mixing $FeCl_2$ with three molar equivalent of 4,4'dimethyl-2,2'-dipyridyl; and iron tris-o-phenanthroline [FeII(o-phen)$_3$] which is available commercially.

The amount of oxidase enzyme added is specified in units of activity where one unit refers to the amount of laccase or peroxidase needed to oxidize one $\mu$mole of ABTS per minute in the presence of sodium acetate buffer (0.1 M, pH 5.0) at room temperature.

Suitable amounts of the enzyme can be readily determined by experiment. In particular, amounts of enzyme of at least 1 U/g and preferably 1 to 20 U/g of pulp have provided goods results.

Laccase is preferably from a fungal source such as that available from commercial suppliers, while peroxidase can be derived from plant or fungal source and is also available from commercial suppliers.

EXAMPLES

Example I

Delignification of SWKP With Laccase and Potassium Octacyanomolybdate

Softwood kraft pulp delignified with oxygen (SWKP-$O_2$) was obtained from a western Canadian kraft mill. The pulp had an initial kappa of 15.6, a brightness of 28.9% and a viscosity of 25.2 mPa.s. The pH of the pulp was adjusted to between 4 and 5 with sulfuric acid. The acidified pulp was then mixed at 10% consistency in a Hobart mixer for 1 minute with a solution containing the mediator, $K_4Mo(CN)_8$. $2H_2O$, at charges of 0.1, 0.25, 0.5 and 1.0% (g per 100 g of pulp) and laccase at 10 U per g of pulp. The pulp was then transferred to a reactor vessel pressurized with oxygen (140 kPa) at temperature of 60° C. After 2 h reaction, the liquid was extracted from the pulp by pressing or filtering. Subsequent alkaline extraction (Ep) was performed at 10% pulp consistency, with 1.7% NaOH and 0.28% $H_2O_2$, for 90 min at 70° C. Following this step, handsheets were prepared from the pulp, and brightness, kappa numbers and viscosities were compared to controls which were treated identically but without laccase.

The resulting pulp in accordance with the present invention has a lower kappa than the control pulps with no loss of viscosity relative to the controls without laccase and mediator.

TABLE I

| | Mediator $K_4Mo(CN)$ % on pulp | Kappa number | Brightness, % | Delignification % | Viscosity (CED), mPa.s. |
|---|---|---|---|---|---|
| Original pulp | — | 15.6 | 28.9 | — | 25.2 |
| Laccase/mediator | 0.1% | 10.1 | 37.1 | 35.1 | 21.9 |
| " | 0.25% | 9.7 | 36.9 | 37.8 | 21.7. |
| " | 0.5% | 9.6 | 38 | 38.5 | 21.1 |
| " | 1.0% | 8.9 | 39.4 | 42.9 | 18.8 |
| Control: No laccase | 0.25% | 12.3 | 37.3 | 21.5 | — |
| Control: No laccase | 1.0% | 11.9 | 37.1 | 23.7 | — |
| Control: No mediator | — | 12.6 | 34.8 | 19.2 | 21 |

Example II

Delignification of HWKP With Laccase and Potassium Octacyanomolybdate

Kraft pulp from mixed hardwood furnish was obtained from eastern Canadian mill. The pulp had an initial kappa of 12.6, a brightness of 32.3%. The pulp was treated with laccase and mediator as described in Example I. The alkaline extraction was performed under the conditions described above, except that 1.4% NaOH and 0.23% $H_2O_2$ were used.

As shown in Example I with softwood pulp, the present invention also applies to delignification of unbleached hardwood pulps.

TABLE II

| | Mediator $K_4Mo(CN)_8$ % on pulp | Kappa number | Brightness, % | Delignification, % |
|---|---|---|---|---|
| Original pulp | — | 12.6 | 32.3 | — |
| Laccase + mediator | 0.1% | 8.7 | 44.2 | 31 |
| Laccase + mediator | 0.5% | 8.4 | 46 | 33.3 |
| Laccase + mediator | 1.0% | 8.2 | 46 | 34.9 |
| Control (no laccase or mediator) | — | 10.5 | 40 | 16.7 |

Example III

Pulp Delignification With Recycled Mediator

The same softwood kraft pulp and reaction conditions as in Example I were used for the first cycle of pulp treatment, with an initial charge of the octacyanomolybdate mediator of 0.1% on pulp. At the end of the treatment, the pulp was filtered and the extracted liquor was kept for further batchs of pulp delignification. The extracted liquor containing the recycled mediator was added to new pulps ($2^{nd}$ to $5^{th}$ cycle). For each cycle, fresh laccase was added and the treatment was run as for the first batch. Pulps treated in each cycle were then extracted with alkali (Ep) as described in the example I.

In accordance with the present invention, the mediator can be recycled after pulp delignification and reused for further batchs of pulp delignification with the same efficiency as a fresh solution of mediator.

TABLE III

| | Kappa number | Brightness, % | Delignification, % | Viscosity (CED), mPa.s. |
|---|---|---|---|---|
| Untreated pulp | 15.6 | 28.9 | — | 25.2 |
| $1^{st}$ cycle | 10.2 | 38.8 | 34.6 | 21.9 |
| $2^{nd}$ cycle | 10.2 | 38.9 | 34.6 | 21.8 |
| $3^{rd}$ cycle | 10.5 | 39.1 | 32.7 | — |
| $4^{th}$ cycle | 10.3 | 37.7 | 34.3 | — |
| $5^{th}$ cycle | 10.3 | 37.4 | 34 | — |
| $6^{th}$ cycle | 10.7 | 37.6 | 31.4 | — |
| $7^{th}$ cycle | 10.4 | 38.9 | 33 | — |
| Control (no laccase or mediator) | 12.6 | 34.8 | 19.2 | 21 |

Example IV

Sequential Treatment of Pulp With Recycled Mediator

Under the same reaction conditions as described in the Example III, a two-stage treatment, using the recycled mediator in the second stage, was performed on the same pulp. After each stage of enzymatic treatment, an alkaline extraction (Ep) was performed.

Results summarized in Table IV show that a considerable reduction of the kappa number is obtained after a second stage treatment with the recycled mediator from the first stage.

TABLE IV

| | Mediator $K_4Mo(CN)_8$ % on pulp | Kappa number | Brightness, % | Delignification, % |
|---|---|---|---|---|
| Original pulp | — | 15.6 | 28.9 | — |
| 1st stage | 0.1% fresh | 10.05 | 36.9 | 35.6 |
| 2nd stage | 0.1% recycled | 7.4 | 46.7 | 52.6 |
| 1st stage | 0.25% fresh | 9.65 | 37.3 | 38.2 |
| 2nd stage | 0.25% recycled | 6.3 | 50.5 | 59.6 |
| Control 1st stage (no laccase or mediator) | — | 12.6 | 34.8 | 19.2 |
| Control 2nd stage (no laccase or mediator) | — | 10 | 40.9 | 36.2 |

Example V

Enzymatic Treatment Within ECF Bleaching Sequence

A softwood kraft pulp partially bleached with chlorine dioxide (SWKP-$D_{100}$) was obtained from an eastern Canadian mill. The pulp (kappa number 8.5, brightness 38.1) was treated with laccase as in Example I with mediator dosages as shown in the table below. The results indicate that mediator dosages as low as 0.05% on pulp are effective for delignification and brightness improvement.

TABLE V

| SWKP-$D_{100}$ Kappa: 8.5 Brightness: 38.1 | Mediator $K_4Mo(CN)_8$ % on pulp | Kappa number after Ep | Brightness after Ep, % | Brightness after $EpD_1$, % |
|---|---|---|---|---|
| $D_{100}$ | — | 3.85 | 54.7 | 82.8 |
| $D_{100}$-Laccase | 0.05% | 3.05 | 62.7 | 86.9 |
| " | 0.2% | 2.85 | 64.3 | 86.3 |
| " | 0.5% | 2.75 | 65.5 | 86.6 |
| " | 1.0% | 2.75 | 66.5 | 86.9 |

Example VI

Comparison of Various Transition Metal Redox Complexes as Laccase Mediators

The same softwood kraft pulp and reaction conditions as in Example I was used with different transition metal complexes as laccase mediators. All metal complexes were used at 0.25% charge on pulp and the enzymatic treatment was followed by an alkaline extraction (Ep) as described in the example I. The redox potentials (Eo) of transition metal complexes were measured by cyclic voltammetry and expressed against a normal hydrogen electrode (NHE). Results shown in the following table VI, demonstrate that other transition metals than molybdenum, such as iron and tungsten, can also be used with laccase to delignify pulp.

TABLE VI

| | Mediator, 0.25% on pulp | Redox potential V | Kappa number | Delignification % |
|---|---|---|---|---|
| Control (no laccase or mediator) | — | — | 12.6 | 19.2 |
| Laccase + mediator | $K_4Mo(CN)_8$ | 0.75 | 9.7 | 36.9 |
| Laccase + mediator | FeII(4,4'dmb pyr)$_3$ | 0.89 | 11.5 | 26.3 |
| Laccase + mediator | FeII(o-phen)$_3$ | 1.1 | 11.7 | 24.7 |
| Laccase + mediator | $K_4W(CN)_8$ | 0.48 | 11.6 | 25.6 |

Example VII

Substitution of Laccase With Peroxidase

Softwood kraft pulp delignified with oxygen (SWKP-$O_2$) was prepared and acidified as described in Example I. The acidified pulp was then mixed at 10% consistency in a Hobart mixer for 1 minute with a solution containing potassium octacyanomolybdate (1% on pulp), the enzyme horseradish peroxidase (HRP, 10 U/g of pulp), and hydrogen peroxide at concentrations shown in the table below. No mediator was added in the control pulps. The pulp was then incubated at room temperature (22° C.) for 3 hours. Alkaline extraction (Ep) and pulp analysis were performed as described in Example I.

The results shown in the Table VII below indicate that the enzyme peroxidase with hydrogen peroxide and a mediator can be. used efficiently to delignify kraft pulp.

TABLE VII

| | $H_2O_2$ % on pulp | Kappa number | Brightness, % | Delignification, % |
|---|---|---|---|---|
| Control (no mediator) | 0.034 | 11.6 | 36.1 | 25.6 |
| Control (no mediator) | 0.34 | 10.9 | — | 28.2 |
| HRP + mediator | 0.034 | 11.3 | 37 | 27.6 |
| " | 0.17 | 10.6 | 37 | 32.1 |
| " | 0.34 | 10.2 | 36.7 | 34.6 |

Example VIII

Colour Stripping From Dyes

Aqueous indigo carmine (50 $\mu$M) was treated with laccase (0.01 U/mL) and $K_4Mo(CN)_8$ mediator over two hours in an air atmosphere at 22° C. The absorbance in the visible region (605 nm) was found to decrease when mediator concentrations above 10 $\mu$M were applied as shown in Table VIII.

TABLE VIII

| $K_4Mo(CN)_8$ | O.D. 605 nm | | |
|---|---|---|---|
| Concentration ($\mu$M) | 10 min | 60 min | 120 min |
| 0 | 1.00 | 1.00 | 1.00 |
| 1 | 1.03 | 1.03 | 1.03 |
| 10 | 1.00 | 0.98 | 0.98 |
| 50 | 0.98 | 0.92 | 0.87 |

We claim:

1. A process for oxidizing a substrate comprising:

a) reacting a substrate to be oxidized, at an acid pH, with:

i) a phenol oxidase, and ii) a transition metal complex redox mediator, said mediator having a redox potential between 0.5 and 1.2 V when measured against a normal hydrogen electrode;

b) oxidizing said complex ii) with said oxidase i) from a reduced state to an oxidized state, and c) oxidizing said substrate with said complex ii) in said oxidized state, said substrate being selected from lignocellulosic pulp or cellulosic pulp whereby a lignocellulosic pulp is delignified by said oxidizing, or a cellulosic pulp is bleached by said oxidizing.

2. A process according to claim 1 wherein said oxidizing in step c) reduces said complex ii) in said oxidized state, whereby the complex ii) in said reduced state is regenerated, and the regenerated complex is oxidized in step b).

3. A process according to claim 2 in which the complex is of the general formula I:

$$M^{m+}(L)_n$$

in which:

M represents a transition metal cation, m+represents the charge of the metal cation, L represents a ligand molecule forming a complex with the metal ion, and n represents the number of ligands L in the complex.

4. A process according to claim 3, in which the transition metal M is molybdenum (Mo), tungsten (w) or iron (Fe), and m ranges from 1 to 6; and in which the ligand L is selected from cyano (CN-), bipyridyl (bipy), 1,10-phenanthroline (o-phen), thiocyanato (SCN-), amine ($NH_3$) or carbonyl (CO), and n ranges from 1 to 8.

5. A process according to claim 4 in which the phenol oxidase is a laccase or a peroxidase.

6. A process according to claim 5 for selectively delignifying a lignocellulose pulp wherein said substrate is a lignocellulose pulp and said complex is a catalytic mediator for lignin oxidation.

7. A process according to claim 6 carried out at a pulp consistency of between 2 and 20%, a pH ranging from 3 to 6, and a temperature between 20° C. and 70° C. for a period of time between 30 and 240 minutes.

8. A process according to claim 7 in which the oxidase is laccase carried out under an oxygen atmosphere at a pressure of 100 kPa to 500 kPa.

9. A process according to claim 8 in which the steps a), b) and c) are performed on the pulp before or following a delignification with chlorine dioxide, thus allowing a lower dosage of chlorine dioxide.

10. A process according to claim 1 in which the complex is of the general formula I:

$$M^{m+}(L)_n$$

in which

M represents a transition metal cation, m+represents the charge of the metal cation, L represents a ligand molecule forming a complex with the metal ion, and n represents the number of ligands L in the complex.

11. A process according to claim 10 in which the transition metal M is molybdenum (Mo), tungsten (W) or iron (Fe), and m ranges from 1 to 6.

12. A process according to claim 10 in which the ligand L is selected from cyano (CN-), bipyridyl (bipy), 1,10-phenanthroline (o-phen), thiocyanato (SCN-), amine ($NH_3$) or carbonyl (CO), and n ranges from 1 to 8.

13. A process according to claim 1 in which the phenol oxidase is a laccase or a peroxidase.

14. A process according to claim 1 for selectively delignifying a lignocellulose pulp wherein said substrate is a lignocellulose pulp and said complex is a catalytic mediator for lignin oxidation.

15. A process according to claim 14 in which the oxidase is laccase carried out under an oxygen atmosphere at a pressure of 100 kPa to 500 kPa.

16. A process according to claim 14 in which the steps a), b) and c) are performed on the pulp before or following a delignification with chlorine dioxide, thus allowing a lower dosage of chlorine dioxide.

17. A process according to claim 1 for bleaching a cellulose pulp wherein said substrate is a cellulosic pulp.

18. A process according to claim 1 carried out at a pulp consistency of between 2 and 20%, a pH ranging from 3 to 6, and a temperature between 20° C. and 70° C. for a period of time between 30 and 240 minutes.

19. A process according to claim 1, wherein said acid pH is from 3 to 6.

* * * * *